US011319770B2

(12) United States Patent
Reyes Villegas et al.

(10) Patent No.: US 11,319,770 B2
(45) Date of Patent: May 3, 2022

(54) DOWNHOLE TOOL WITH A RETAINED OBJECT

(71) Applicant: Weatherford Technology Holdings, LLC, Houston, TX (US)

(72) Inventors: Jorge Reyes Villegas, Houston, TX (US); Nauman H. Mhaskar, Cypress, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 16/911,211

(22) Filed: Jun. 24, 2020

(65) Prior Publication Data

US 2021/0404285 A1 Dec. 30, 2021

(51) Int. Cl.
*E21B 33/129* (2006.01)
*E21B 23/01* (2006.01)

(52) U.S. Cl.
CPC ..... *E21B 33/1293* (2013.01); *E21B 23/01* (2013.01)

(58) Field of Classification Search
CPC ..... E21B 33/1293; E21B 23/01
See application file for complete search history.

(56) References Cited

U.S. PATENT DOCUMENTS

| | | | |
|---|---|---|---|
| 6,394,180 | B1 | 5/2002 | Berscheidt et al. |
| 6,491,116 | B2 | 12/2002 | Berscheidt et al. |
| 7,100,700 | B2 | 9/2006 | Davis et al. |
| 8,127,856 | B1 | 3/2012 | Nish et al. |
| 8,955,605 | B2 | 2/2015 | VanLue |
| 8,997,853 | B2 | 4/2015 | VanLue |
| 9,010,411 | B1 | 4/2015 | VanLue |
| 9,016,364 | B2 | 4/2015 | Chenault et al. |
| 9,074,439 | B2 | 7/2015 | VanLue |
| 9,097,095 | B2 | 8/2015 | VanLue |
| 9,103,177 | B2 | 8/2015 | VanLue |
| 9,316,086 | B2 | 4/2016 | VanLue |
| 9,334,703 | B2 | 5/2016 | VanLue |
| 9,464,499 | B1 | 10/2016 | Sullivan |
| 9,562,416 | B2 | 2/2017 | VanLue |
| 9,567,827 | B2 | 2/2017 | Davies et al. |
| 9,574,421 | B1 | 2/2017 | Saraya |

(Continued)

OTHER PUBLICATIONS

FET; RockKit Deployment System; Retrieved from the Internet: https://www.f-e-t.com/products/completions/well-completion/composite-plugs/prodrill-velocity-series-composite-plugs/rockit-deployment-system.

(Continued)

*Primary Examiner* — James G Sayre
(74) *Attorney, Agent, or Firm* — Patterson + Sheridan, LLP

(57) ABSTRACT

A method and apparatus for a downhole tool including a retained object. The downhole tool includes a longitudinal axis, a cone including a seat having an opening, and a shoe member. The downhole tool further includes a slip assembly disposed between the cone and the shoe member. The downhole tool further includes a mandrel disposed in the opening of the seat. The downhole tool further includes an attachment member attaching the mandrel to the shoe member, wherein the attachment member is eccentric to the longitudinal axis. The downhole tool further includes a setting sleeve abutting the cone. The downhole tool further includes the object, wherein the object configured to engage with the seat, and wherein the object is disposed between the mandrel and the setting sleeve.

20 Claims, 8 Drawing Sheets

(56) References Cited

U.S. PATENT DOCUMENTS

| | | | |
|---|---|---|---|
| 9,617,816 | B1 | 4/2017 | Sullivan |
| 9,631,453 | B2 | 4/2017 | VanLue |
| 9,657,547 | B2 | 5/2017 | Raggio |
| 9,689,228 | B2 | 6/2017 | VanLue |
| 9,719,320 | B2 | 8/2017 | VanLue |
| 9,725,982 | B2 | 8/2017 | VanLue |
| 9,759,029 | B2 | 9/2017 | Davies et al. |
| 9,777,551 | B2 | 10/2017 | Davies et al. |
| 9,896,899 | B2 | 2/2018 | Davies et al. |
| 9,963,955 | B2 | 5/2018 | Tolman et al. |
| 9,970,256 | B2 | 5/2018 | Davies et al. |
| 9,976,382 | B2 | 5/2018 | VanLue |
| 10,024,126 | B2 | 7/2018 | Davies et al. |
| 10,036,221 | B2 | 7/2018 | Davies et al. |
| D827,000 | S | 8/2018 | VanLue |
| 10,156,120 | B2 | 12/2018 | Davies et al. |
| 10,167,698 | B2 | 1/2019 | Rosenthal |
| 10,214,981 | B2 | 2/2019 | Davies et al. |
| 10,246,967 | B2 | 4/2019 | Davies et al. |
| 10,316,617 | B2 | 6/2019 | Davies et al. |
| 10,480,267 | B2 | 11/2019 | Hou et al. |
| 10,480,277 | B2 | 11/2019 | VanLue |
| 10,480,280 | B2 | 11/2019 | Hou et al. |
| 10,494,895 | B2 | 12/2019 | VanLue |
| 10,570,694 | B2 | 2/2020 | Davies et al. |
| D877,216 | S | 3/2020 | Davies et al. |
| D877,217 | S | 3/2020 | Davies et al. |
| 10,605,020 | B2 | 3/2020 | Davies et al. |
| 10,605,044 | B2 | 3/2020 | Davies et al. |
| 10,633,534 | B2 | 4/2020 | Davies et al. |
| 10,711,563 | B2 | 7/2020 | Davies et al. |
| 10,781,659 | B2 | 9/2020 | Avila et al. |
| 10,801,298 | B2 | 10/2020 | Hughes et al. |
| 10,801,304 | B2 | 10/2020 | Hughes et al. |
| 10,900,321 | B2 | 1/2021 | Vanlue |
| 10,907,441 | B2 | 2/2021 | Hou et al. |
| 2002/0096365 | A1 | 7/2002 | Berscheidt et al. |
| 2018/0142096 | A1 | 5/2018 | Li et al. |
| 2018/0179852 | A1 | 6/2018 | Hou et al. |
| 2019/0093448 | A1 | 3/2019 | Rochen et al. |
| 2019/0162044 | A1 | 5/2019 | Dirocco |
| 2019/0203557 | A1 | 7/2019 | Dirocco |
| 2020/0048981 | A1* | 2/2020 | Coon ..... E21B 33/128 |
| 2020/0149368 | A1* | 5/2020 | Yoshida ..... E21B 23/06 |
| 2020/0277831 | A1* | 9/2020 | Kellner ..... E21B 23/01 |

OTHER PUBLICATIONS

Riglock and Downhole Technology's Ball-in-Place Boss Hog Plug; Dec. 18, 2017; Retrieved from the Internet: https://www.youtube.com/watch?v=5xYgwipHO7I.

Lowering the Total Cost of Plug-n-Perf Operations; May 11, 2017; Retrieved from the Internet: https://www.youtube.com/watch?v=4X6OJW7Bqi0.

Plug and Pert Completion; Mar. 20, 2014; Retrieved from the Internet: https://www.youtube.com/watch?v=Z-vCBV1AhBs.

Fas Drill Ultra Frac Plug—Improved Pump Down Efficiency and Reduced Millout Times; Retrieved from the internet: <https://cdn.brandfolder.io/OUSGG99Q/as/q5afrs-6c8ir4-df01bg/FasDrill_Ultra_Frac_Plug_-_H012490-DS.pdf?quality=85>.

ProDrill® Velocity™ Frac plug with RocKit Deployment System; Retrieved from the Internet <https://www.youtube.com/watch?v=c74er4-_2OI>.

Minima Composite Frac Plug; Frequently Asked Questions; Retrieved from the Internet; <https://www.weatherford.com/en/documents/technical-specification-sheet/products-and-services/completions/minima-composite-frac-plug-faq/>.

Apex Ball-In-Place; Retrieved from the Internet: <https://www.peakcompletions.com/catalog/product/completion-tools/plug-and-perf/apex-ball-in-place/>.

Schlumberger: FracXion, Fully composite frac plug. Retrieved from the Internet: https://www.slb.com/completions/well-completions/frac-plugs-and-sleeves/frac-plugs/fracxion-fully-composite-frac-plug.

Schlumberger: FracXion Micro fully composite frac plug; Retrieved from the Internet: https://ofmp-media.azureedge.net/media/cpl/documents/product_sheet_fracxion_micro_v1.pdf.

* cited by examiner

DOWNHOLE TOOL WITH A RETAINED OBJECT

BACKGROUND

Field

Embodiments of the present disclosure generally relate to a downhole tool with an object configured to engage a seat retained therein such that the object is run into the wellbore with the downhole tool.

Description of the Related Art

Various conventional downhole tools have a seat engageable with an object. The objects are engageable with the seat to facilitate downhole operations with the downhole tool. For example, an object is released to travel downhole to engage a seat of a fracturing plug. After the object reaches the seat, fracturing fluid pressure is increased to fracture a formation. However, there is a time delay between when the object is deployed into the wellbore and when the object reaches the seat. For example, a setting tool used to deploy the fracturing plug downhole must be retrieved to the surface before the object can be deployed to the fracturing plug.

There is a need for a downhole tool that allows an object to be run into the wellbore with the downhole tool. Additionally, there is a need in the art for the downhole tool to accommodate large object.

SUMMARY

In one embodiment, a downhole tool includes a horizontal axis perpendicular to a longitudinal axis, a cone including a seat, and a shoe member. The downhole tool further includes a slip assembly disposed between the cone and the shoe member. The downhole tool further includes a mandrel attached to the shoe member, the mandrel having a first portion and a second portion, the second portion including a surface. The downhole tool further includes a setting sleeve abutting the cone. The downhole tool further includes a space between the surface and the setting sleeve, wherein a portion of the space is between the horizontal axis and the surface. The downhole tool further includes an object configured to engage with the seat, wherein the object is disposed in the space.

In one embodiment, a downhole tool includes a longitudinal axis, a cone including a seat having an opening, and a shoe member. The downhole tool further includes a slip assembly disposed between the cone and the shoe member. The downhole tool further includes a mandrel disposed in the opening of the seat. The downhole tool further includes an attachment member attaching the mandrel to the shoe member, wherein the attachment member is eccentric to the longitudinal axis. The downhole tool further includes a setting sleeve abutting the cone. The downhole tool further includes an object configured to engage with the seat, wherein the object is disposed between the mandrel and the setting sleeve.

In one embodiment a method of performing a wellbore operation includes deploying a downhole tool into a wellbore with a setting tool, the downhole tool including a mandrel attached to a shoe member by an attachment member, wherein the attachment member is located eccentric to a longitudinal axis of the downhole tool, wherein mandrel obstructs a seat of the downhole tool, and wherein the downhole tool further including an object retained therein. The method further includes using the setting tool to engage a slip assembly of the downhole tool with a downhole surface. The method further includes detaching the mandrel from the shoe member. The method further includes engaging the seat with the object after the seat is no longer obstructed by the mandrel.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, may admit to other equally effective embodiments.

FIG. 4A is a perspective view of the mandrel. FIG. 4B is an end view of the mandrel.

FIG. 5 illustrates a cross-sectional view of the downhole tool deployed in a downhole tubular.

FIG. 6 illustrates a cross-sectional view of the downhole tool with a slip assembly and seal assembly engaging the downhole tubular.

FIG. 7 illustrates a cross-sectional view of the downhole tool to show a first portion of the downhole tool separated from a second portion of the downhole tool.

FIG. 8 illustrates a cross-sectional view of the downhole tool to show the object engaged with a seat of the first portion of the downhole tool.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Figure 1:
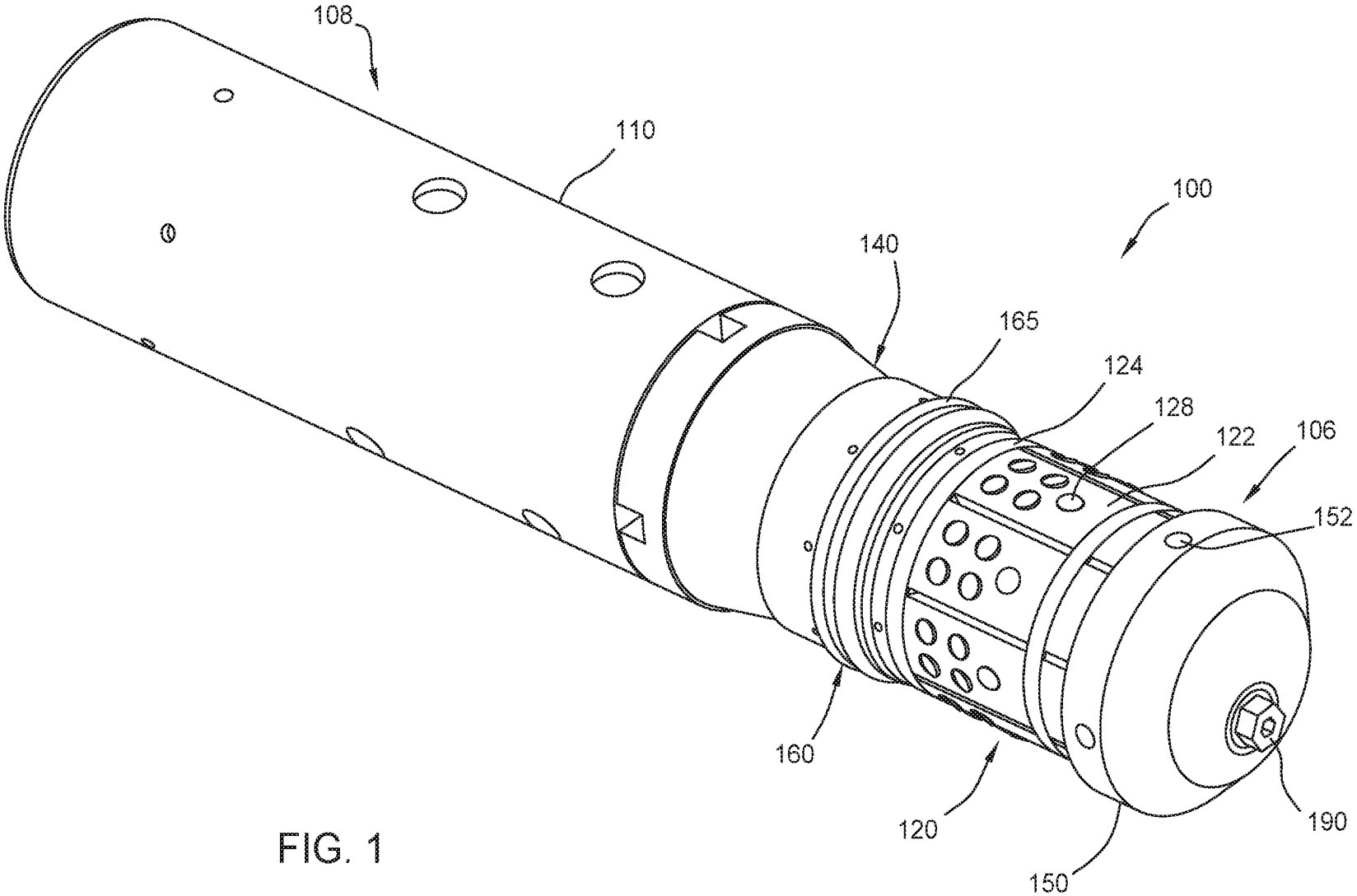
FIG. 1 illustrates a perspective view of a downhole tool with an object retained therein.

FIG. 1 is a perspective view of a downhole tool 100 according to one embodiment of this disclosure. The downhole tool 100 may be a bridge plug as shown, but it could also be a downhole tool with a seat configured to catch an object and a slip assembly configured to grip a downhole surface.

Figure 2:
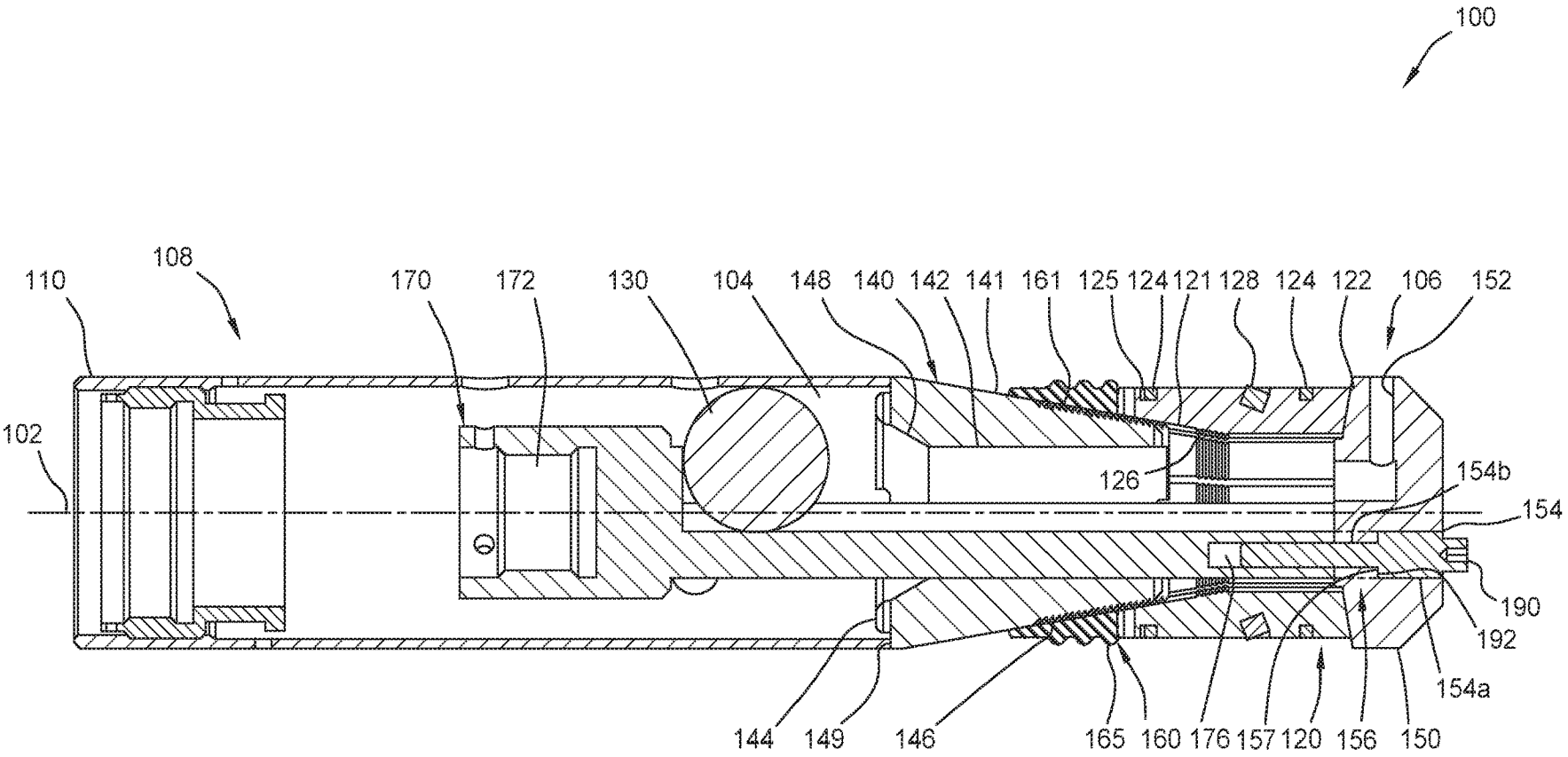
FIG. 2 illustrates a cross-sectional view of the downhole tool shown in FIG. 1.

FIG. 2 is a cross-sectional view of FIG. 1. As shown in FIGS. 1 and 2, the downhole tool 100 may include a setting sleeve 110, a slip assembly 120, an object 130, a cone 140, a shoe member 150, a seal assembly 160, a mandrel 170, and an attachment member 190. The object 130 is disposed, and thus retained, within the downhole tool 100. As shown in FIG. 2, the object 130 is retained between the setting sleeve 110 and the mandrel 170. A space 104 is present between the setting sleeve 110 and the mandrel 170. The object 130 is disposed in the space 104. The object 130 is run-in the wellbore with the downhole tool 100. In some embodiments, the object 130 is disposed between the mandrel 170 and the cone 140. As shown, the object 130 is a ball. However, the object 130 may also be a dart or other flow restricting device configured to engage with a seat 148.

The downhole tool 100 includes a first portion 106 and a second portion 108. The first portion 106 includes the slip assembly 120, the object 130, the cone 140, the shoe member 150, and the seal assembly 160. The second portion 108 includes the setting sleeve 110, the mandrel 170, and the attachment member 190. The second portion 108 may be used to set one or more components of the first portion 106 downhole. The second portion 108 may be separated from the first portion 106 downhole. While the first portion 106 remains downhole, the second portion 108 may be retrieved to surface.

The cone 140 includes an inclined surface 141, a bore 142, one or more protrusions 144, the seat 148, and an abutment surface 149. The inclined surface 141 may include a friction surface 146. The friction surface 146 may include a plurality of teeth. The mandrel 170 is disposed in the bore 142 of the cone 140. The cone 140 is arranged on the mandrel 170 with the inclined surface 141 facing the shoe member 150. The slip assembly 120 and the seal assembly 160 are at least partially disposed around the cone 140. The seal assembly 160 and the slip assembly 120 are disposed between the shoe member 150 and the setting sleeve 110. The setting sleeve 110 abuts the abutment surface 149 of the cone 140.

Figure 3:
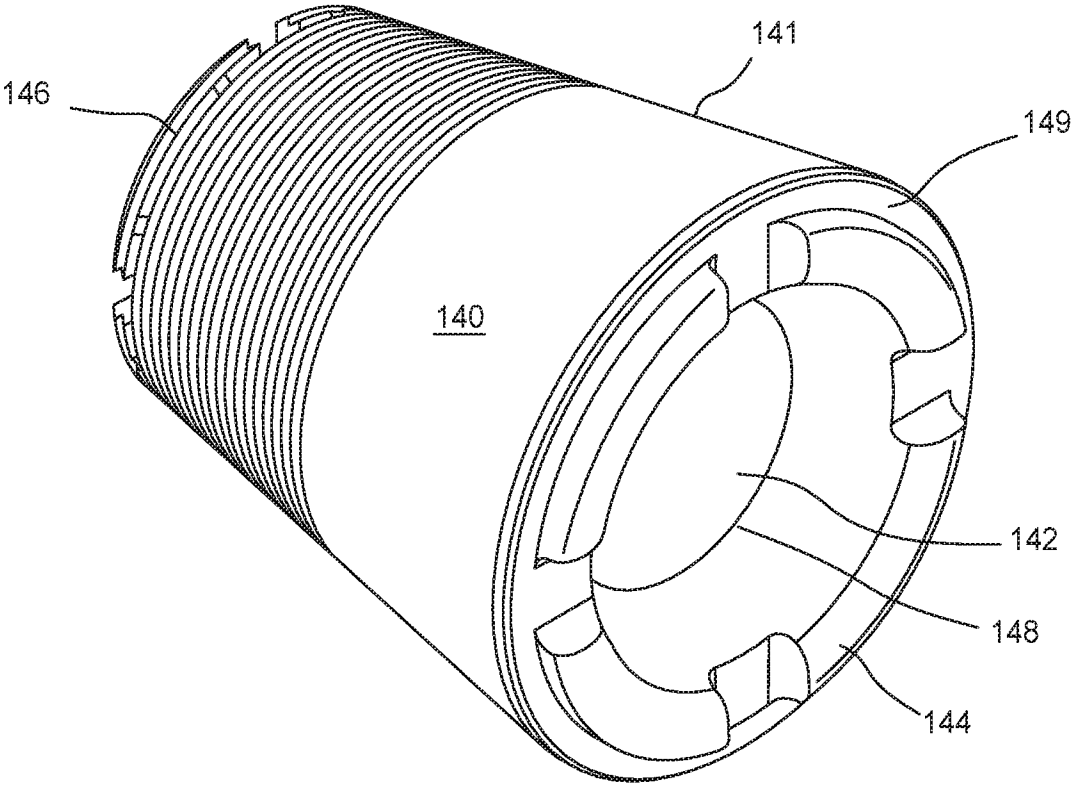
FIG. 3 illustrates a perspective view of a cone of the downhole tool.

FIG. 3 is a perspective view of the cone 140 to better show the protrusions 144. The protrusions 144 may be one or more ribs. The protrusions 144 are configured to maintain the alignment of the setting sleeve 110 with the cone 140. The protrusions 144 may have a close tolerance with the inner diameter of the setting sleeve 110 to minimize the movement of the setting sleeve 110 along the abutment surface 149. Maintaining the alignment of the setting sleeve 110 relative to the cone 140 decreases the chances of the object 130 becoming wedged between the setting sleeve 110 and the mandrel 170. The setting sleeve 110, which is coupled to the setting tool, abuts the cone 140 so that the setting tool can be used to set the slip assembly 120.

The slip assembly 120 may include a plurality of slip segments 122. Each slip segment 122 may include grooves 125 and gripping elements 128. For example, the gripping elements 128 may be one or more buttons. Two bands 124 may retain the slip segments 122 to the downhole tool 100. Each band 124 may be disposed in a corresponding groove 125 in the slip segments 122. In one embodiment, the bands 124 are expandable. Each slip segment 122 includes an inclined surface 121 corresponding to the inclined surface 141 of the cone 140. The inclined surface 121 of each slip segment 122 may include a friction surface 126, such as a plurality of teeth, configured to mate with the friction surface 146. The seal assembly 160 may be an elastomer ring as shown in FIG. 1. The seal assembly 160 includes an inclined surface 161 corresponding to the inclined surface 141 of the cone 140. As shown in FIG. 1, the seal assembly 160 may include one or more sealing protrusions 165 configured to engage the downhole surface.

When the downhole tool 100 is set by a setting tool, the slip assembly 120 travels along the inclined surface 141 from a radially retracted position to a radially extended position and the seal assembly 160 travels along the inclined surface 141 from a radially retracted position to a radially expanded position. When the slip assembly 120 is in the radially extended position, the gripping elements 128 grip (e.g., bite) into the downhole surface, such as an inner surface of a casing or the surface of the wellbore, to anchor the downhole tool 100 in place downhole. When the seal assembly 160 is in the radially expanded position, the seal assembly 160 is sealingly engaged with the downhole surface and blocks the annulus between the downhole tool 100 and the downhole surface. The friction surface 126 interacts with the friction surface 146 of the cone 140 to prevent the slip segments 122 from traveling back down the inclined surface 141. Therefore, the friction surface 126 interacts with the friction surface 146 of the cone 140 to maintain each slip segment 122 in the radially extended position. The extended slip segments 122 also maintain the seal assembly in the radially expanded position. In some embodiments, the inclined surface 161 of the seal assembly 160 may include a friction surface, such as a plurality of teeth, configured to mate with the friction surface 146 to maintain the seal assembly 160 in the radially expanded position.

Alternatively, the seal assembly 160 may include a plurality of seal segments. The plurality of seal segments may include one or more sealing protrusions 165 and an inclined surface 161. The seal segments may have a wedged end configured to interlock with between two alternative slip segments of an alternative slip assembly. The alternative slip segments may have wedged ends. The alternative slip segments may further include one or more sealing protrusions configured to engage the downhole surface when moved to a radially extended position. When the alternative slip assembly and the alternative seal assembly 160 are set, the sealing protrusions 165 of the seal segments are configured to form a seal ring with the sealing protrusions of the slip segments. This seal ring seals the annulus between the downhole tool 100 and the downhole surface.

Figure 4A:
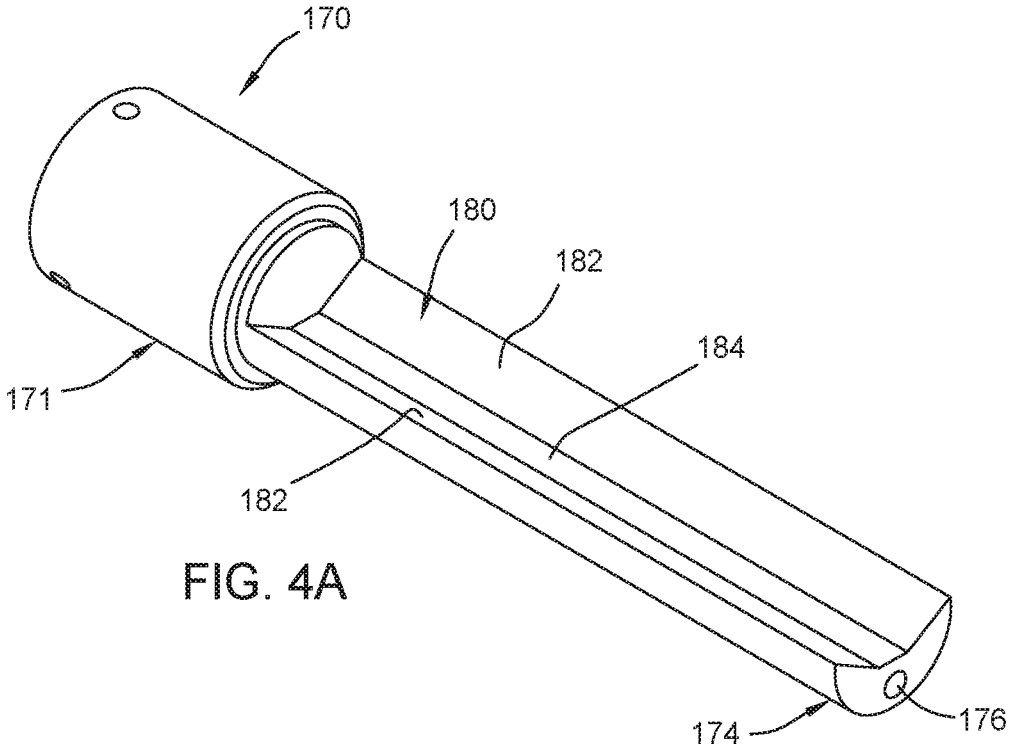
FIG. 4A-4B illustrate a mandrel of the downhole tool.
Figure 4B:
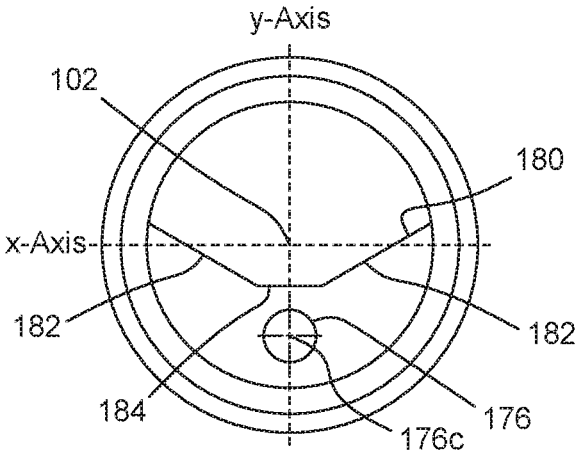

The mandrel 170 is shown in FIG. 4A-4B. In this embodiment, the mandrel 170 includes a first portion 171 and a second portion 174. The first portion 171 may include a bore 172, such as a blind bore, configured to receive a portion of the setting tool. The second portion 174 includes a bore 176 configured to receive a portion of the attachment member 190. The bore 176 may be threaded. The second portion 174 further includes a surface 180 configured to accommodate retaining and releasing the object 130 within the downhole tool 100. The surface 180 is shown having two inclined portions 182 which are inclined relative to an intermediate portion 184. For example, the two inclined portions 182 may be angled at or about 45 degrees relative to the intermediate portion 184.

The surface 180 may alternatively be a curved surface, such as a surface defined by a parabolic curve or a curve defined along a radius. In some embodiments, the intermediate portion 184 is curved instead of being flat. The surface 180 may alternatively be a flat horizontal surface without inclined portions. The surface 180 is shaped to accommodate the object 130 and to facilitate the release of the object 130 as the mandrel 170 is moved relative to the shoe member 150. In some embodiments, the surface 180 may have a gradient extending along the full length of the second portion 174, such that the thickness of the second portion 174 progressively decreases toward the end with the bore 176. The gradient facilitates the travel of the object 130 from the deployment positon to the seat 148. The gradient may also allow the mandrel 170 to withdraw from the cone 140 without becoming impeded by the object 130. In some embodiments, the surface 180 may include a gradient which extends along a partial length of the second portion 174. In one embodiment, the surface 180 may be formed by machining the mandrel 170.

FIG. 4B illustrates an end view of the mandrel 170. An x, y axis are shown superimposed on the mandrel 170. The origin of the x, y axis shows the longitudinal axis 102 (e.g., longitudinal centerline) of the of the downhole tool 100. As shown, the bore 176 is positioned eccentrically to the longitudinal axis 102 such that the center 176*c* of the bore 176 is located on the y-axis. As shown, the inclined portions 182 cross the x-axis (e.g., horizontal axis) and the intermediate portion is offset from the x-axis. However, the bore 176 may be positioned at other eccentric locations relative to the longitudinal axis 102 in the second portion 174 having sufficient thickness to accommodate the bore 176. Thus, the attachment point of the mandrel 170 to the shoe member 150 is eccentric to the longitudinal axis 102. In some embodiments, and as shown in FIGS. 2 and 4B, a portion of the space 104 is between the surface 180 and the x-axis. The eccentric location of the bore 176 and shape of the surface 180 increases the space 104 within the downhole tool 100 for the object 130.

The eccentric location of the bore 176 and the shape of the surface 180 allow for an object 130 with a larger size, such as an object with a larger diameter, to be retained in the downhole tool 100 than in conventional tools with an object, such as a ball, retained within during run-in. Also, the diameter of a flow path in the downhole tool 100 defined by the seat 148 and bore 142 may be larger than in conventional tools. In one embodiment, the diameter of the object 130 may be more than half the inner diameter of the setting sleeve 110. In some embodiments, the object may have a diameter about two-thirds the inner diameter of the setting sleeve 110. In some embodiments, the object 130 has a diameter between one half and about two-thirds the inner diameter of the setting sleeve 110. In some embodiments, and as shown in FIG. 2, the object 130 may be sized such that the longitudinal axis 102 and x-axis intersect the object 130 when the object 130 is retained in the downhole tool 100. For example, the longitudinal axis 102 and the x-axis may intersect the object 130 when the object 130 contacts the surface 180. In some embodiments, the object 130 is sized such that the surface of the object 130 contacts the surface 180 and the inner surface of the setting sleeve 110 when the object 130 is retained in the downhole tool 100.

In some embodiments, the center 176*c* of the bore 176 may be aligned with the longitudinal axis 102, which results in smaller space 104 to accommodate an object 130 with a decreased diameter. For example, the surface 180 may be shaped such that the space 104 does not include a portion between the x-axis and the surface 180.

The mandrel 170 is attached at one end to the shoe member 150 by the attachment member 190. The shoe member 150 may include one or more flow bores 152. As shown, the opening of the flow bores 152 is positioned about the circumference of the shoe member 150 such that the flow bores 152 optionally provide a tortuous flow path to minimize the instances of inadvertent setting of the slip assembly 120 by fluid flow. The shoe member 150 further includes an attachment bore 154 configured to receive the attachment member 190. The attachment bore 154 is aligned with the bore 176. As shown in FIG. 2, the attachment bore 154 is eccentric to the longitudinal axis 102. In this embodiment, the attachment bore 154 may include a first portion 154*a* having a first diameter and a second portion 154*b* having a second diameter which is less than the first diameter. A shoulder 157 in the attachment bore 154 demarcates the change between the first portion 154*a* and the second portion 154*b*. The first portion 154*a* and/or the second portion 154*b* may be threaded. In another embodiment, the attachment bore 154 may be a single diameter bore.

The attachment member 190, such as a bolt, may include a shoulder 192 configured to engage the shoulder 157. The attachment member 190 may include threads configured to engage with the threads of the attachment bore 154. In some embodiments, the attachment member 190 and the attachment bore 154 are not threadedly engaged. A portion of the attachment member 190 extends into the bore 176 of the mandrel 170.

After the slip assembly 120 and seal assembly 160 have been set, the mandrel 170 is detached from the shoe member 150. In the illustrated embodiment, the mandrel 170 is detached from the shoe member 150 by pulling the mandrel 170 with the setting tool until the material defining the second bore portion 154*b* fails. As such, and as shown in FIG. 7, a portion 156 of the shoe member 150 is sheared away from the remainder of the shoe member 150 to detach the mandrel 170. The portion 156 is shown bounded by dashed lines in FIGS. 2, 5, and 6. Force applied to the mandrel 170 by the setting tool is transferred to the attachment member 190. The attachment member 190 transfers the force to the shoe member 150 by the abutment of the shoulders 157, 192 and/or the threaded connection between the attachment member 190 and the attachment bore 154. Once the force applied to the attachment member 190 exceeds the shear strength of the shoe member 150, the portion 156 is sheared from the of the shoe member 150, resulting in the detachment of the mandrel 170 from the shoe member 150. If the attachment bore 154 is threadedly coupled to the attachment member 190, then the threads may also shear.

Alternatively, the attachment member 190 may be a shear ring (not shown) disposed in the attachment bore 154 to releasably attach the mandrel 170 to the shoe member 150. Instead of shearing away a portion 156 of the shoe member 150, the application of force to the mandrel 170 shears the shear ring to release the mandrel 170 from the shoe member 150. Alternatively, the attachment bore 154 may have a uniform diameter with internal threads threadedly engaged to the attachment member 190. Force is applied to the attachment member 190, such as a threaded bolt, until the threaded attachment between the attachment member 190 and the attachment bore 154 fails.

Figure 5:
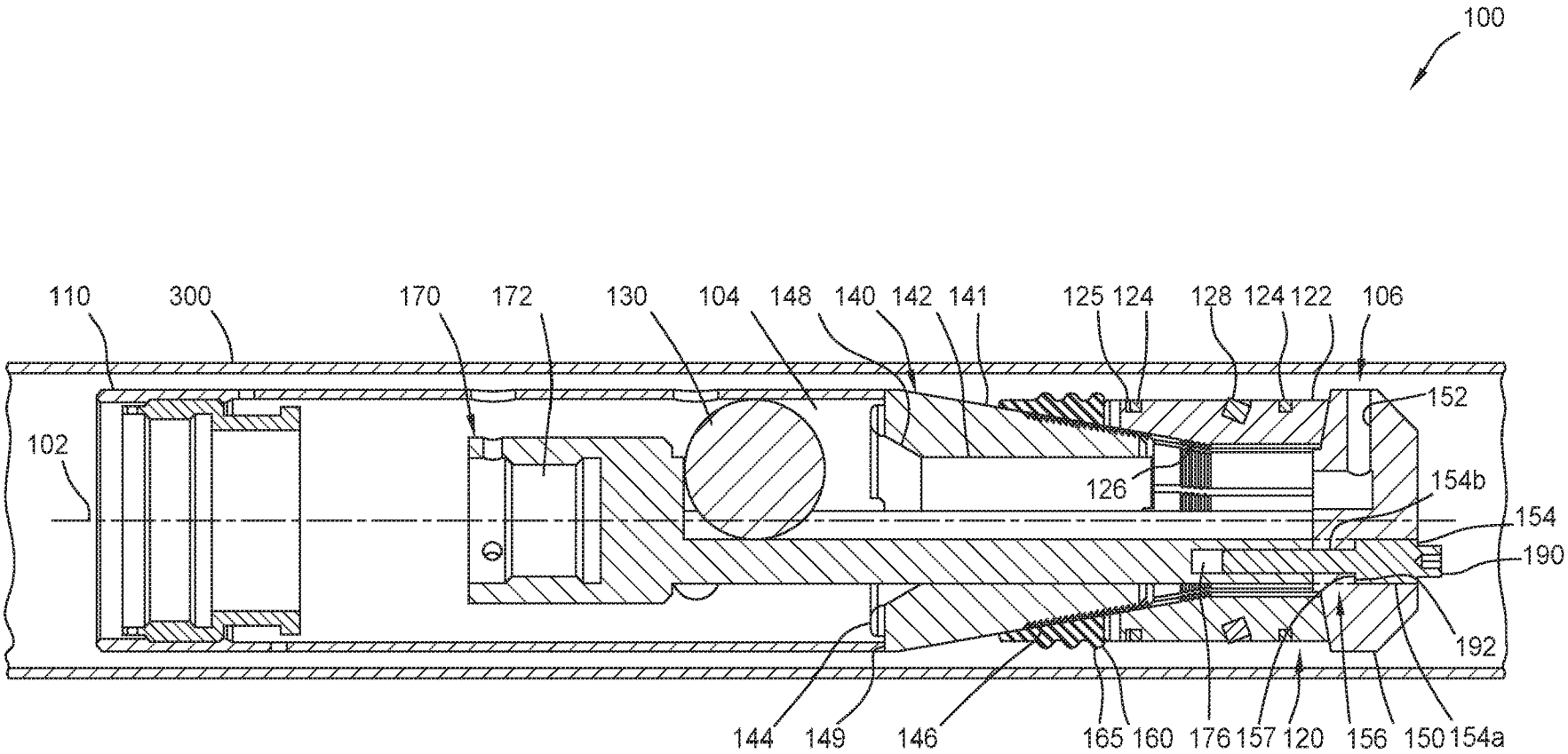
FIGS. 5-8 illustrate an exemplary sequential operation of the downhole tool shown in FIG. 1.

FIGS. 5-8 illustrate an exemplary sequence of operating the downhole tool 100. FIG. 5 illustrates the downhole tool 100 after being deployed downhole by the setting tool (not shown) into a downhole tubular 300. The downhole tubular 300 may be a casing.

Once deployed in the wellbore, the downhole tool 100 is set by the setting tool. The setting tool may be a wireline setting tool which uses conventional techniques of pulling the mandrel 170 while simultaneously pulling the slip assembly 120 against the cone 140. The cone 140 is axially abutted against the setting sleeve 110. As a result, the slip assembly 120, such as the slip segments 122, rides up the cone 140 and moves to the radially extended position to engage the downhole surface, such as the inner surface of the surrounding downhole tubular 300. In this manner, the slip assembly 120 anchors the first portion 106 in place in the downhole tubular 300. The slip assembly 120 also causes the seal assembly 160 to move up the inclined surface of the cone 140. As the seal assembly 160 moves up the inclined surface 141, the seal assembly 160 is expanded into the radially expanded position and sealingly engages with the downhole tubular 300.

Figure 6:
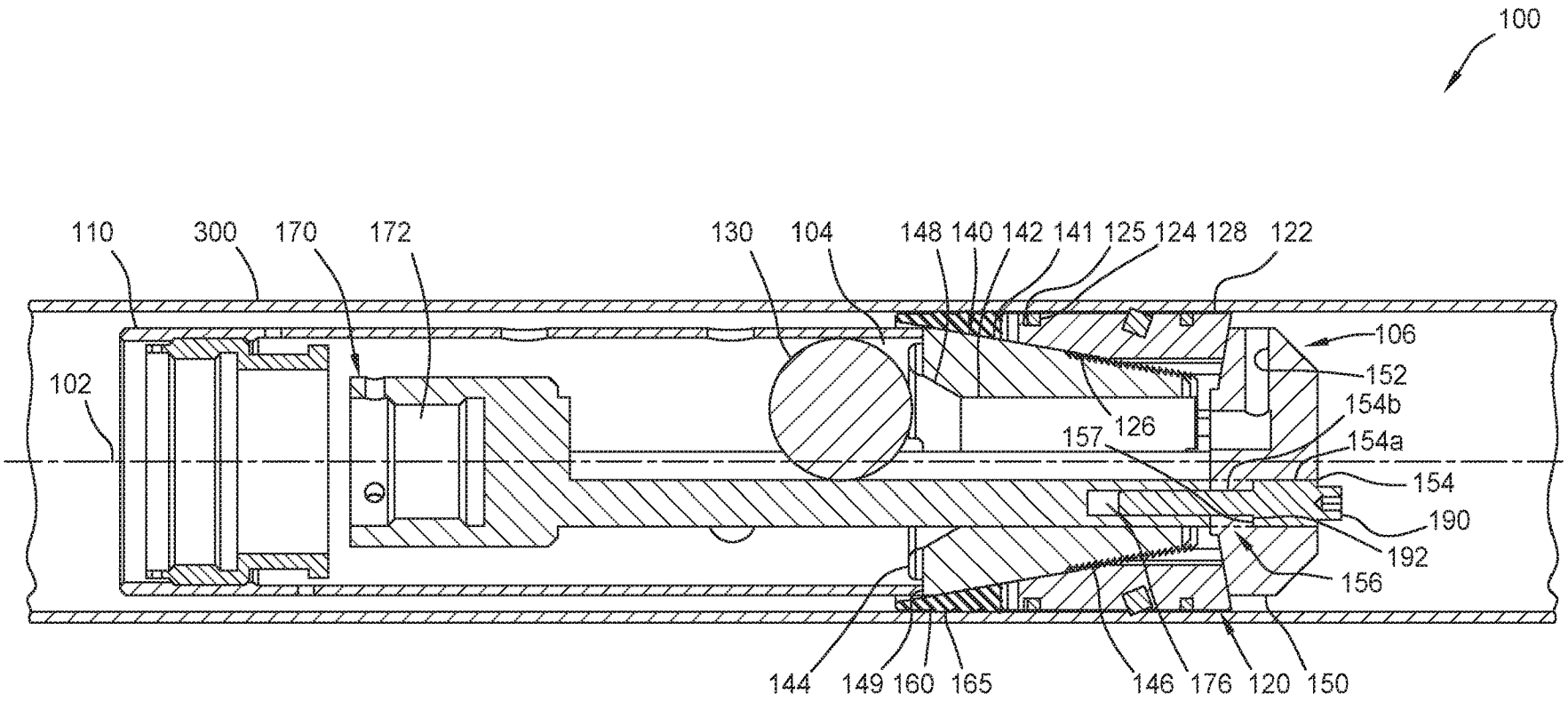
Figure 7:
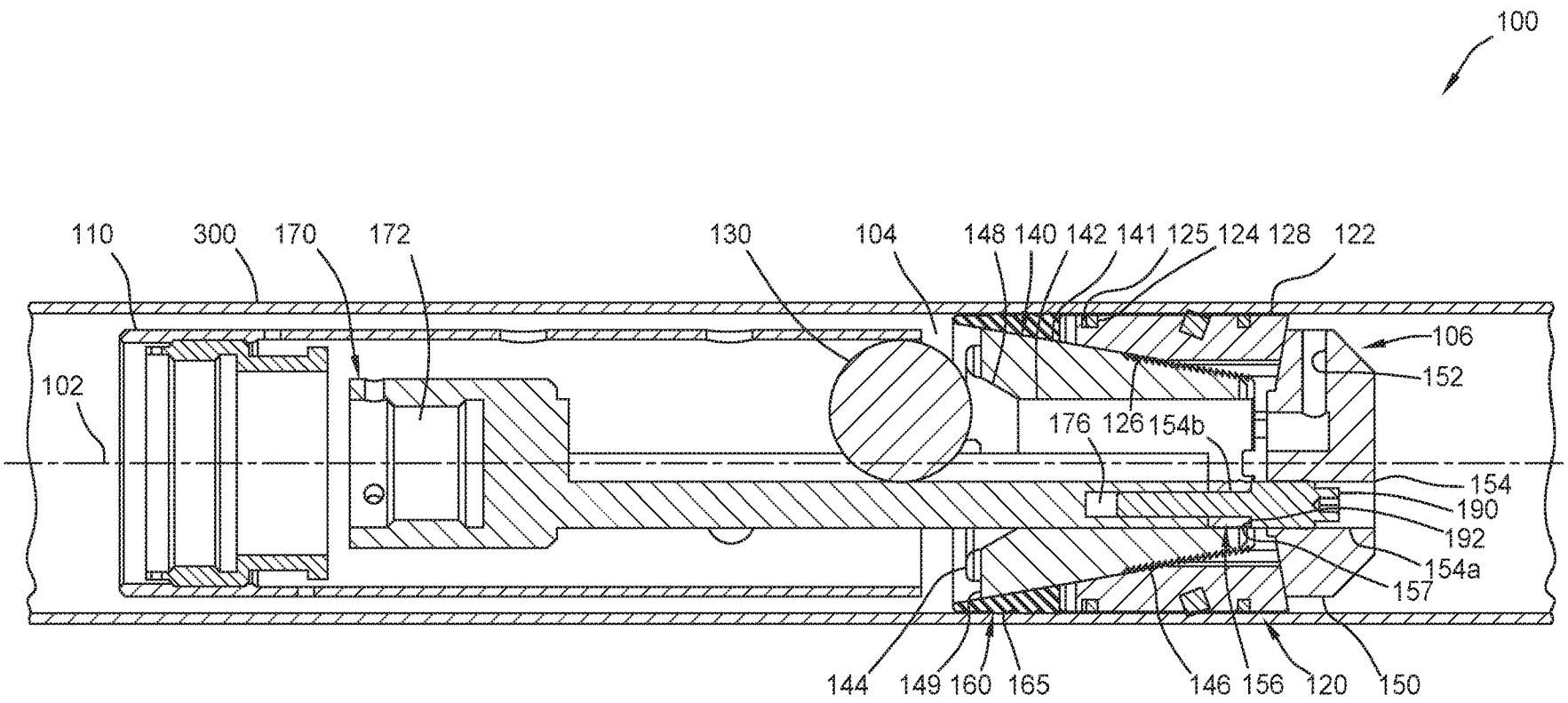

FIG. 6 illustrates the downhole tool 100 after force is applied to the mandrel 170 to engage the slip assembly 120 and the seal assembly 160 against the downhole tubular 300.

The setting tool continues to apply force to the mandrel 170 until the mandrel 170 is detached from the shoe member 150. Once sufficient force is applied to the mandrel 170, the portion 156 is sheared from the shoe member 150. As a result, the mandrel 170 is detached from the shoe member 150. As the mandrel 170 is withdrawn from the cone 140 by the setting tool, the setting sleeve 110 moves away from the cone 140 due to the connection between the setting sleeve 110 and the setting tool.

FIG. 7 illustrates the downhole tool 100 after the mandrel 170 is detached from the shoe member 150. As shown, the setting sleeve 110 is no longer in an abutting relationship with the abutment surface 149 of the cone 140. While the mandrel 170 is no longer attached to the shoe member 150, the mandrel 170 is blocking the seat 148 such that the object 130 cannot engage the seat 148. The slip assembly 120 and the seal assembly 160 are set against the downhole tubular 300, and the slip assembly 120 anchors the first portion 106 in the downhole tubular 300.

Figure 8:
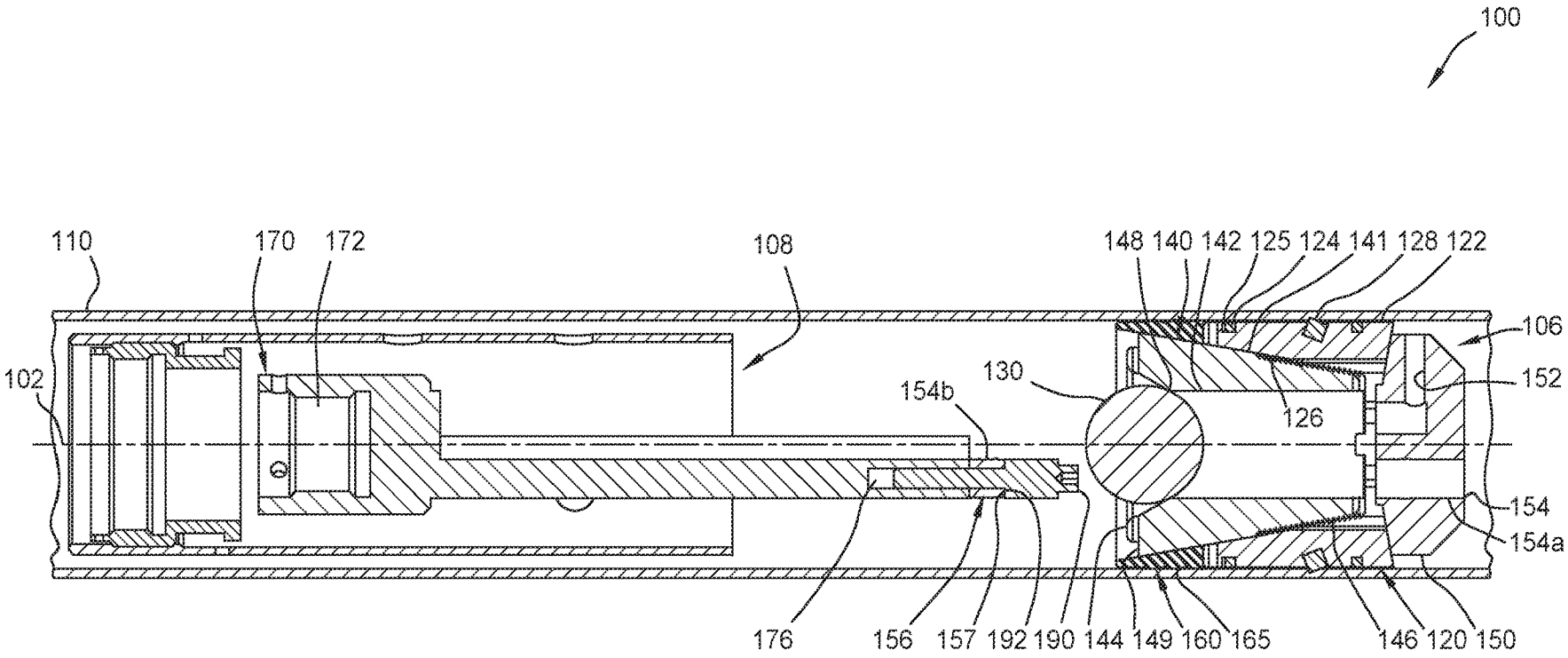

Once the mandrel 170 is detached from the shoe member 150, the setting tool, the setting sleeve 110, and the mandrel 170 may be retrieved to the surface. The setting tool moves the setting sleeve 110 and the mandrel 170 uphole to remove the mandrel 170 from obstructing the seat 148. The detachment of the mandrel 170 from the shoe member 150 and the subsequent uphole movement of the mandrel 170 release the object 130. FIG. 8 illustrates the released object 130 engaged with the seat 148.

The object 130 may engage the seat 148 based on the inclination of the first portion 106 of the downhole tool 100 in the wellbore. For example, the wellbore and downhole tubular 300 may be substantially vertical, which may result in the object 130 settling on the seat 148 due to gravitational forces. In some embodiments, such as when the first portion 106 is set in a substantially horizontal wellbore, fluid flow in the wellbore may be used to force the object 130 into engagement with the seat 148. For example, a fracturing fluid including one or more proppants may be introduced into the wellbore above the first portion 106 to engage the object 130 with the seat 148.

Wellbore fluid pressure uphole of the first portion 106 may be increased after the object 130 engages the seat 148. For example, fracturing fluid can be pressurized above seated object 130 such that the fracturing fluid enters and fractures the formation surrounding the wellbore.

Embodiments of the downhole tool 100 decreases the time needed to complete a fracturing operation. In conventional fracturing operations, an object is dropped into the wellbore at the surface and flowed downhole by fluids, such as a fracturing fluid, until it reaches a seat of a conventional tool deployed downhole, such as a conventional fracturing plug. However, the object cannot be deployed into the wellbore until the setting tool used to deploy the conventional tool is retrieved from the surface. The downhole tool 100 disclosed herein, however, deploys the object 130 downhole with the downhole tool 100 during run-in. The object 130 is released downhole, and a fracturing operation may begin once the setting tool is retrieved from the wellbore instead of waiting until an object travels downhole like in conventional operations. As a result, the fracturing operations may be conducted more efficiently by using the downhole tool 100.

In some embodiments, the first portion 106 includes degradable, such as dissolvable, materials. For example, one or more chemical solutions may be pumped downhole to degrade one or more components of the first portion 106. As a result, one or more individual components of the first portion 106 may be degraded such that the first portion 106 may be flushed from the wellbore without the need of milling out the first portion 106.

For example, at least one of the slip assembly 120, the object 130, the cone 140, the shoe member 150, and the seal assembly 160 can be manufactured from a degradable material. Exemplary degradable materials may include degradable polymers, such as polylactic acid (PLA) based polymers, polyglycolic acid (PGA) based polymers, degradable urethane, and other polymers that are dissolvable over time. In one example, one or more components of the downhole tool 100 are composed of a dissolvable material. An exemplary dissolvable material is a dissolvable polymeric material. For example, the cone 140 and seal assembly 160 may be formed from a degradable polymer. In some embodiments, the slip assembly 120 includes slip segments 122 that are degradable. The degradable slip segments 122 may include non-degradable sub-components. For example, the slip segments 122 may include gripping elements 128 which are formed from a non-degradable material, such as ceramic, powder metal, cast iron, ductile iron, and alloy steel. Exemplary degradable materials may include dissolvable metal alloys, such as magnesium alloys and aluminum alloys. For example, the slip assembly 120, object 130, the cone 140, and/or shoe member 150 may include a dissolvable metal alloy.

In some embodiments, one or components of the first portion 106 may be formed from a degradable material, such as a dissolvable metallic material, that is reactive with a chemical solution that is an electrolyte solution. The electrolyte solution to degrade the downhole tool may include an electrolyte is selected from the group comprising, consisting of, or consisting essentially of solutions of an acid, a base, a salt, and combinations thereof. A salt can be dissolved in water, for example, to create a salt solution. Common free ions in an electrolyte include, but are not limited to, sodium ($Na^+$), potassium ($K^+$), calcium ($Ca^{2+}$), magnesium ($Mg^{2+}$), chloride ($Cl^-$), bromide ($B^-$) hydrogen phosphate ($HPO_4^{2-}$), hydrogen carbonate ($HCO_3^-$), and any combination thereof. Preferably, the electrolyte contains halide ions such as chloride ions.

In some embodiments, a mill-out operation is conducted to remove the first portion 106 from the wellbore. For example, the mill-out operation may occur after a fracturing operation.

In some embodiments, the downhole tool 100 does not include a seal assembly 160.

In one embodiment, a downhole tool includes a horizontal axis perpendicular to a longitudinal axis, a cone including a seat, and a shoe member. The downhole tool further includes a slip assembly disposed between the cone and the shoe member. The downhole tool further includes a mandrel attached to the shoe member, the mandrel having a first portion and a second portion, the second portion including a surface. The downhole tool further includes a setting sleeve abutting the cone. The downhole tool further includes a space between the surface and the setting sleeve, wherein a portion of the space is between the horizontal axis and the surface. The downhole tool further includes an object configured to engage with the seat, wherein the object is disposed in the space.

In some embodiments of the downhole tool, an attachment point between the mandrel and the shoe member is eccentric to the longitudinal axis.

In some embodiments of the downhole tool, wherein the attachment point is an attachment member.

In some embodiments of the downhole tool, the downhole tool further includes an attachment member, wherein the shoe member includes an attachment bore, wherein the mandrel is attached to the shoe member by the attachment member, and wherein the attachment member is partially disposed in the attachment bore.

In some embodiments of the downhole tool, the attachment bore includes a shoulder and the attachment member includes a shoulder. A portion of the shoe member is configured to be sheared from the shoe member when the mandrel is detached from the shoe member.

In some embodiments of the downhole tool, the attachment member is a bolt.

In some embodiments of the downhole tool, the object has a diameter greater than half an inner diameter of the setting sleeve.

In some embodiments of the downhole tool, the surface is defined by a first and a second inclined portion and an intermediate portion between the first and second inclined portions, wherein the first and second inclined portions cross the horizontal axis.

In some embodiments of the downhole tool, the surface includes a gradient.

In some embodiments of the downhole tool, the downhole tool further includes a seal assembly.

In one embodiment, a downhole tool includes a longitudinal axis, a cone including a seat having an opening, and a shoe member. The downhole tool further includes a slip assembly disposed between the cone and the shoe member. The downhole tool further includes a mandrel disposed in the opening of the seat. The downhole tool further includes an attachment member attaching the mandrel to the shoe member, wherein the attachment member is eccentric to the longitudinal axis. The downhole tool further includes a setting sleeve abutting the cone. The downhole tool further includes an object configured to engage with the seat, wherein the object is disposed between the mandrel and the setting sleeve.

In some embodiments of the downhole tool, the attachment member is partially disposed in an attachment bore of the shoe member, wherein the attachment bore includes a shoulder configured to abut a shoulder of the attachment member.

In some embodiments of the downhole tool, the mandrel includes a first portion and a second portion, wherein the second portion includes a surface and the attachment member is partially disposed in the second portion.

In some embodiments of the downhole tool, the surface is defined by a first and a second inclined portion and an intermediate portion between the first and second inclined portions.

In some embodiments of the downhole tool, the surface includes a gradient.

In some embodiments of the downhole tool, the surface is curved.

In some embodiments of the downhole tool, the object is a ball.

In one embodiment a method of performing a wellbore operation includes deploying a downhole tool into a wellbore with a setting tool, the downhole tool including a mandrel attached to a shoe member by an attachment member, wherein the attachment member is located eccentric to a longitudinal axis of the downhole tool, wherein mandrel obstructs a seat of the downhole tool, and wherein the downhole tool further including an object retained therein. The method further includes using the setting tool to engage a slip assembly of the downhole tool with a downhole surface. The method further includes detaching the mandrel from the shoe member. The method further includes engaging the seat with the object after the seat is no longer obstructed by the mandrel.

In one embodiment, the method of performing the wellbore operation includes performing a fracturing operation.

In one embodiment of the method of performing the wellbore operation, detaching the mandrel from the shoe member includes shearing away a portion of the shoe member.

While the foregoing is directed to embodiments of the present disclosure, other and further embodiments of the disclosure may be devised without departing from the basic scope thereof, and the scope thereof is determined by the claims that follow.

What is claimed is:

1. A downhole tool, comprising:
a cone including a seat;
a shoe member;
a slip assembly disposed between the cone and the shoe member;
a mandrel attached to the shoe member, the mandrel having a first portion and a second portion, the second portion including a surface, wherein the mandrel has a horizontal axis perpendicular to a longitudinal axis and intersecting the longitudinal axis;
a setting sleeve abutting the cone;
an object configured to engage with the seat, wherein the object is disposed in a space between the surface and the setting sleeve, wherein a portion of the space is between the horizontal axis and the surface.

2. The downhole tool of claim 1, further comprising:
wherein an attachment point between the mandrel and the shoe member is eccentric to the longitudinal axis.

3. The downhole tool of claim 2, wherein the attachment point is an attachment member.

4. The downhole tool of claim 1, further comprising:
an attachment member;
wherein the shoe member includes an attachment bore, wherein the mandrel is attached to the shoe member by the attachment member, and wherein the attachment member is partially disposed in the attachment bore.

5. The downhole tool of claim 4, wherein the attachment bore includes a shoulder and the attachment member includes a shoulder, wherein a portion of the shoe member is configured to be sheared from the shoe member when the mandrel is detached from the shoe member.

6. The downhole tool of claim 4, wherein the attachment member is a bolt.

7. The downhole tool of claim 1, wherein the object has a diameter greater than half an inner diameter of the setting sleeve.

8. The downhole tool of claim 1, wherein the surface is defined by a first and a second inclined portion and an intermediate portion between the first and second inclined portions, wherein the first and second inclined portions cross the horizontal axis.

9. The downhole tool of claim 1, wherein the surface includes a gradient.

10. The downhole tool of claim 1, further comprising a seal assembly.

11. A downhole tool, comprising:
a cone including a seat having an opening;
a shoe member;

a slip assembly disposed between the cone and the shoe member;

a mandrel disposed in the opening of the seat, wherein the mandrel includes a central axis;

an attachment member attaching the mandrel to the shoe member, wherein the attachment member has a centerline that is eccentric to a central axis of the downhole tool;

a setting sleeve abutting the cone; and an object configured to engage with the seat, wherein the object is disposed between the mandrel and the setting sleeve.

12. The downhole tool of claim 11, wherein:

the attachment member is partially disposed in an attachment bore of the shoe member, wherein the attachment bore includes a shoulder configured to abut a shoulder of the attachment member.

13. The downhole tool of claim 11, wherein the mandrel includes a first portion and a second portion, wherein the second portion includes a surface and the attachment member is partially disposed in the second portion.

14. The downhole tool of claim 13, wherein the surface is defined by a first and a second inclined portion and an intermediate portion between the first and second inclined portions.

15. The downhole tool of claim 13, wherein the surface includes a gradient.

16. The downhole tool of claim 13, wherein the surface is curved.

17. The downhole tool of claim 13, wherein the object is a ball.

18. A method of performing a wellbore operation, comprising:

deploying a downhole tool into a wellbore with a setting tool, the downhole tool including a mandrel attached to a shoe member by an attachment member, wherein the attachment member has a centerline that is located eccentric to a central axis of the downhole tool, wherein the mandrel obstructs a seat of the downhole tool, and wherein the downhole tool further including an object retained therein;

using the setting tool to engage a slip assembly of the downhole tool with a downhole surface;

detaching the mandrel from the shoe member; and engaging the seat with the object after the seat is no longer obstructed by the mandrel.

19. The method of claim 18, further comprising performing a fracturing operation.

20. The method of claim 18, wherein detaching the mandrel from the shoe member includes shearing away a portion of the shoe member.

* * * * *